US008459153B2

(12) United States Patent
Abel

(10) Patent No.: US 8,459,153 B2
(45) Date of Patent: Jun. 11, 2013

(54) COMBINATION WRENCH

(75) Inventor: Michael Abel, Radevormwald (DE)

(73) Assignee: Wera-Werk Hermann Werner GmbH & Co. KG (DE)

( * ) Notice: Subject to any disclaimer, the term of this patent is extended or adjusted under 35 U.S.C. 154(b) by 18 days.

(21) Appl. No.: 13/163,497

(22) Filed: Jun. 17, 2011

(65) Prior Publication Data

US 2011/0239830 A1 Oct. 6, 2011

Related U.S. Application Data

(63) Continuation of application No. PCT/EP2009/066389, filed on Dec. 4, 2009.

(30) Foreign Application Priority Data

Dec. 19, 2008 (DE) ..... 10 2008 055 559

(51) Int. Cl.
*B25B 13/08* (2006.01)

(52) U.S. Cl.
USPC ..... 81/119; 81/186

(58) Field of Classification Search
USPC ..... 81/119, 186, 185.1, 121.1, 125.1
See application file for complete search history.

(56) References Cited

U.S. PATENT DOCUMENTS 561,305 A * 6/1896 Barrett ..... 81/119
1,297,846 A 3/1919 Herrman
1,314,044 A * 8/1919 Buker ..... 81/185
2,655,065 A 10/1953 Murphy
3,242,775 A * 3/1966 Hinkle ..... 81/119
3,247,742 A * 4/1966 Woodbury ..... 81/185.1
3,604,106 A 9/1971 Borries
3,921,476 A * 11/1975 Evans ..... 81/119
4,889,020 A 12/1989 Baker
5,582,083 A * 12/1996 Baker ..... 81/119
5,782,148 A 7/1998 Kerkhoven (Continued)

FOREIGN PATENT DOCUMENTS

DE 29508482 U1 8/1995
DE 29708596 U1 7/1997

(Continued)

OTHER PUBLICATIONS

International Search Report and Written Opinion of the International Searching Authority; PCT/EP2009/066389; Mar. 11, 2010; 16 pages.

(Continued)

*Primary Examiner* — Hadi Shakeri
(74) *Attorney, Agent, or Firm* — St. Onge Steward Johnston & Reens LLC

(57) ABSTRACT

A wrench including an inward opening that has a multi-point configuration for partially-surrounding engagement in a torque-transmitting manner on a polygonal profile of a nut or a bolt head, a radial jaw opening being associated with the inward opening and at least two corners of the multi-point configuration each having a stop for a portion of an end face of the polygonal profile. In order to extend the range of use of the wrench, the jaw opening has oppositely-disposed jaw cheeks as the opening of an open-end wrench for torque-transmitting engagement on the polygonal profile, the jaw cheeks extending over the corners of the multi-point configuration on only one wide face (of the wrench).

20 Claims, 28 Drawing Sheets

U.S. PATENT DOCUMENTS

| | | | | | |
|---|---|---|---|---|---|
| 5,983,758 | A | * | 11/1999 | Tanner | 81/186 |
| D422,467 | S | * | 4/2000 | Mollack | D8/28 |
| 6,112,625 | A | | 9/2000 | Turtle | |
| 6,186,032 | B1 | | 2/2001 | Raines | |
| 6,899,000 | B1 | * | 5/2005 | Hsien | 81/119 |
| 7,117,770 | B2 | * | 10/2006 | Hsien | 81/186 |
| 7,340,983 | B2 | | 3/2008 | Ling et al. | |
| 7,628,212 | B2 | * | 12/2009 | Tjader | 166/380 |
| 7,673,542 | B2 | * | 3/2010 | Ling et al. | 81/186 |

FOREIGN PATENT DOCUMENTS

| | | | |
|---|---|---|---|
| DE | 29905913 | U1 | 7/1999 |
| DE | 202004003343 | U1 | 4/2004 |
| DE | 202004003399 | U1 | 7/2004 |
| DE | 69827139 | T2 | 2/2006 |
| EP | 1003627 | B1 | 5/2000 |
| FR | 886095 | A | 10/1943 |
| GB | 2454505 | A | 5/2009 |

OTHER PUBLICATIONS

European Search Report; Application No. EP 11 17 7798; Issued: Nov. 25, 2011; Mailing Date: Dec. 6, 2011; 9 pages.

* cited by examiner

COMBINATION WRENCH

CROSS-REFERENCE TO RELATED APPLICATIONS

The present application is a continuation of pending International patent application PCT/EP2009/066389 filed on Dec. 4, 2009 which designates the United States and claims priority from German patent application 10 2008 055 559.2 filed on Dec. 19, 2008. The content of all prior applications is incorporated herein by reference.

FIELD OF THE INVENTION

The invention relates to a wrench comprising an inward opening that has a multi-point configuration for partially-surrounding engagement in a torque-transmitting manner on a polygonal profile of a nut or a bolt head, a radial jaw opening being associated with the inward opening and at least two corners of the multi-point configuration each having a stop for a portion of an end face of the polygonal profile.

BACKGROUND OF THE INVENTION

A wrench of this kind is known from U.S. Pat. No. 3,604,106. In this, there is disclosed an open box-end wrench similar to DIN 898 having a radial opening for insertion of a shank of a bolt, the hexagonal head of which can be turned by a polygonal point configuration. In the corner regions of the polygonal point configuration, there are stop balls, which engage against an end face portion of the hexagonal cross-section of the bolt head for axial retention in the inward opening.

In U.S. Pat. No. 5,782,148, there is described a socket for fitting onto a bolt head that has the shape of a hexagonal profile. The internal cross-section of this tool, which is also called a socket, has two cross-sectional planes, one above the other in the axial direction. The cross-sectional plane adjacent to the opening has a twelve-fold symmetry and twelve angular notches in total, which correspond to the total of six hexagon corners of the hexagonal cross-section of the bolt head. When a bolt head is inserted into the wrench opening, every second angular notch is then occupied by a hexagon corner. The second cross-sectional plane, which is at a distance from the opening, has only a six-fold symmetry, specifically the internal shape of a hexagon. This hexagonal internal cross-section is formed by elongated angular notches. Between these elongated angular notches, there are as a result shorter angular notches, which are closed at the end. These portions of material, which close off the angular notches, provide three flanks that act as stops for end face portions of the hexagon cross-section, when its hexagon corners are inserted into the short angular notches. The hexagonal cross-section of the bolt head can therefore be inserted into the opening of the socket in two angular positions which differ by 30°. It extends therefore more deeply or less deeply into the socket.

A similar jaw arrangement, but on a box-end wrench, is described by EP 1 003 627 B1, in which, depending on the angular position of the hexagon cross-section, the bolt head lies either in a stop position or can be inserted through the jaw opening.

U.S. Pat. No. 7,340,983 B2 describes a ratchet wrench having an internal polygonal cross-section, which consists of two different cross-section portions that lie side by side in the axial direction. A first cross-section portion has a twelve-fold symmetry. A second portion has a six-fold symmetry, so that a nut abuts against stops in a first angular position, and in a second angular position, the nut can be inserted through the opening of the wrench.

It is an object of the invention to broaden the field of use of a wrench of the generic kind.

SUMMARY OF THE INVENTION

This object is met by the invention specified in the claims, each claim also representing an independent solution to the problem or in particular relating to a specific development of the invention specified in claim 1.

First and foremost, it is provided that the jaw opening has two oppositely-disposed jaw cheeks as the opening of an open-end wrench for torque-transmitting engagement on the polygonal profile, the jaw cheeks extending over the corners of the multi-point configuration on only one wide face (of the wrench). The jaw cheeks may be formed as parallel cheeks and be based on a hexagonal cross-section. They may however also be portions of a twelve-sided cross-section, which is displaced relative to the hexagonal cross-section. The jaw opening has a width which corresponds to the size across the flats of the hexagonal cross-section, i.e. to the spacing between the two parallel cheeks. As a result of this opening, it is possible to push the parallel cheeks onto the hexagon faces of the polygonal profile in the radial direction toward the axis of rotation of the hexagonal cross-section. As a result of this configuration, a new kind of open-end/box-end wrench is provided. If the parallel cheeks are used as zones for introducing torque, the tool can then be used as a known open-end wrench. At the same time, it is however also possible to put the wrench onto the bolt head or the nut in the axial direction in an angular position turned through 30°. The polygonal corner regions of the polygonal profile then engage on the jaw cross-section portions, which in each case define one, preferably two, flanks. The tool is then used as a known open box-end wrench, no stop balls now having to be provided. The stops are instead formed by portions of the parallel cheeks. The preferably two flanks of the jaw cross-section portions form an angular notch. A third flank of this angular notch forms in each case the stops for the end surface portions of the hexagon cross-section, so that the wrench is secured in an axial direction. At the same time, it is assured that the wrench cannot slip off in the radial direction, since diametrically opposed corner regions of the bolt head engage in diametrically opposite angular notches. The bolt head finds a radially restrained seat in the jaw. The angular notches are defined by a total of three flanks, two flanks forming zones for introducing torque, these zones being at angle of 120° to one another. The third flank, which exercises the stop function, is at a right angle to these two flanks. In a development of the invention, it is provided that the third flank, which forms the stop, is defined by the rear of a steel plate. A steel plate of a hardened steel is preferred for this. The hardness of the material of the steel plate is greater than the hardness of the material of the steel base body that forms the head of the wrench. The hardness of the steel plate may be 50 HRC or more. It may be between 50 and 60 HRC. The hardness of the steel of the steel base body is preferably in the range between 35 and 49 HRC. The steel plate also forms at the same time the parallel cheeks and is fixedly connected to the wide side of a head disposed at the end of an actuating arm, the head having the jaw opening. In a preferred development of the invention, the parallel cheeks run into further cheeks, which can likewise enter into a torque-transmitting engagement against the hexagon surfaces of the bolt head, with formation of a 120° angle in the region of the rear of the jaw, i.e. in a region of the jaw which is opposite from the opening. Corner recesses can likewise be locally associated with these two further cheeks. The torque-transferring flanks of these corner recesses are thus aligned with the torque-transferring flanks of the angled cheeks that are spatially associated with the parallel cheeks. In this way, the bolt head is enclosed in a first angular position with four corner regions in a total of four angular notches and is not only secure against rotation, but is also held fixedly in the jaw in the radial direction and in an axial direction. In the second angular position, turned through 30° compared with the first, a total of four hexagon surfaces engage against their corresponding cheeks, which are provided by the steel plate. The connection of the steel plate to the steel base body can be by way of a force-fit, or by a positive connection, or by bonding, i.e. in particular by an adhesive bond, welding, pinning or screwing. It is however advantageous for the connection to the steel base body to be selected in such a way that the steel plate can be exchanged. The plate preferably extends in its size over one-half of the thickness of the material of the steel base body. The wrench according to the invention thus has, in an axial direction relative to the direction of rotation of the nut or screw, two torque introducing zones that lie directly adjacent to one another, one of which is formed on the basis of an (open) twelve-edged box-end wrench cross-section and the other on the basis of an open-end wrench profile. Instead of the twelve-edge box-end wrench cross-section, a 24 edge cross-section can however also be adopted as a base. The two torque-introducing zones lie one above the other in the axial direction in such a way that a nut inserted into the torque-introducing zone, which is produced on the basis of an (open) twelve-edge cross-section (or a 24-edge cross-section) of a box-end wrench, abuts on stops by way of two diametrically opposed corner regions of the end face. The nut enclosed in this torque-introducing zone is thus secured in the radial direction and in the axial direction. If the nut or the bolt head is engaged into the torque-introducing zone configured on the basis of an open-end wrench cross-section, the wrench can then be placed onto the hexagon cross-section of the bolt head or of the nut in the radial direction and also in the axial direction. Introduction of the torque is then effected substantially via the steel plate. Since it is hardened, the jaw of the wrench does not bend. The cheek portions of the other torque-introducing zone may in this operating position likewise engage in a torque-transferring manner on the polygon surfaces of the hexagon profile. The flanks of the steel plate opposite the jaw opening may converge in the shape of a Vee at an angle of 120°. These two cheeks that converge toward one another in the shape of a Vee may be offset forwards in the direction of the jaw opening, so that the rear of the steel plate, in the region of these rearward cheeks, forms a stop step, against which two complete edge portions of the end face of the bolt head may abut. In a development of the invention, it is provided that the flanks of the multi-point arrangement of the steel base body that are associated with the two parallel cheeks merge into arcuate portions. These arcuate portions then run into a transverse surface of the steel base body, against which an edge region of the polygonal cross-section can engage. As already explained above, the jaw faces may also be portions of twelve-edge cross-section. The cheeks that run parallel to one another and form the jaw opening are then interrupted by twelve-edge jaw surface portions. In this configuration, the multi-point configuration is based on a 24-edge profile, so that the twelve-edge surfaces form stops. A wrench formed in this way can be used as an open-end wrench, as a box-end wrench with a stop, and as a box-end wrench without a stop.

BRIEF DESCRIPTION OF THE DRAWINGS

Exemplary embodiments of the invention are described below with reference to accompanying drawings, in which:

FIG. 7 shows the wrench in an illustration corresponding to FIG. 4, with a bolt head inserted in the jaw in a first rotational position, FIG. 18 is a first perspective illustration of a sixth embodiment.

DETAILED DESCRIPTION OF THE INVENTION

Figure 1:
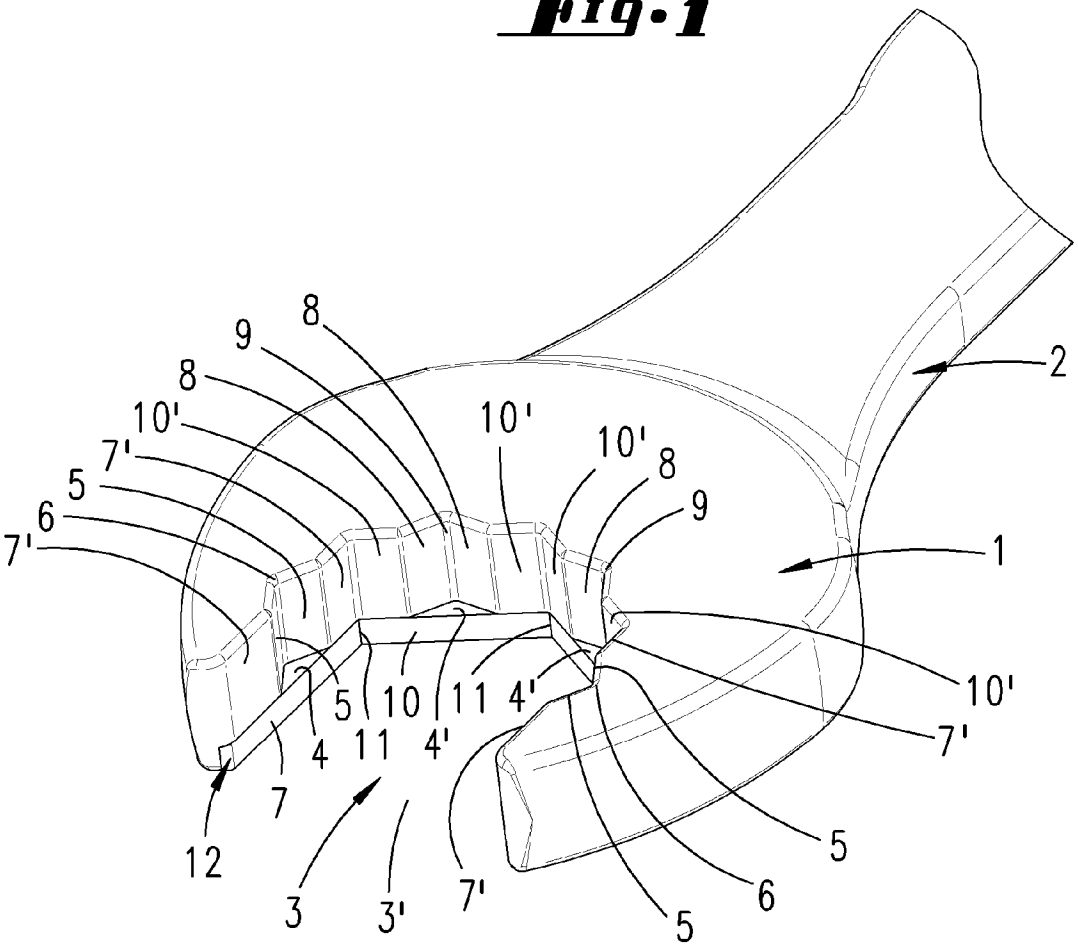
FIG. 1 shows the head of an open-end wrench in perspective view in a first viewing direction with the actuating arm being partly broken away.
Figure 2:
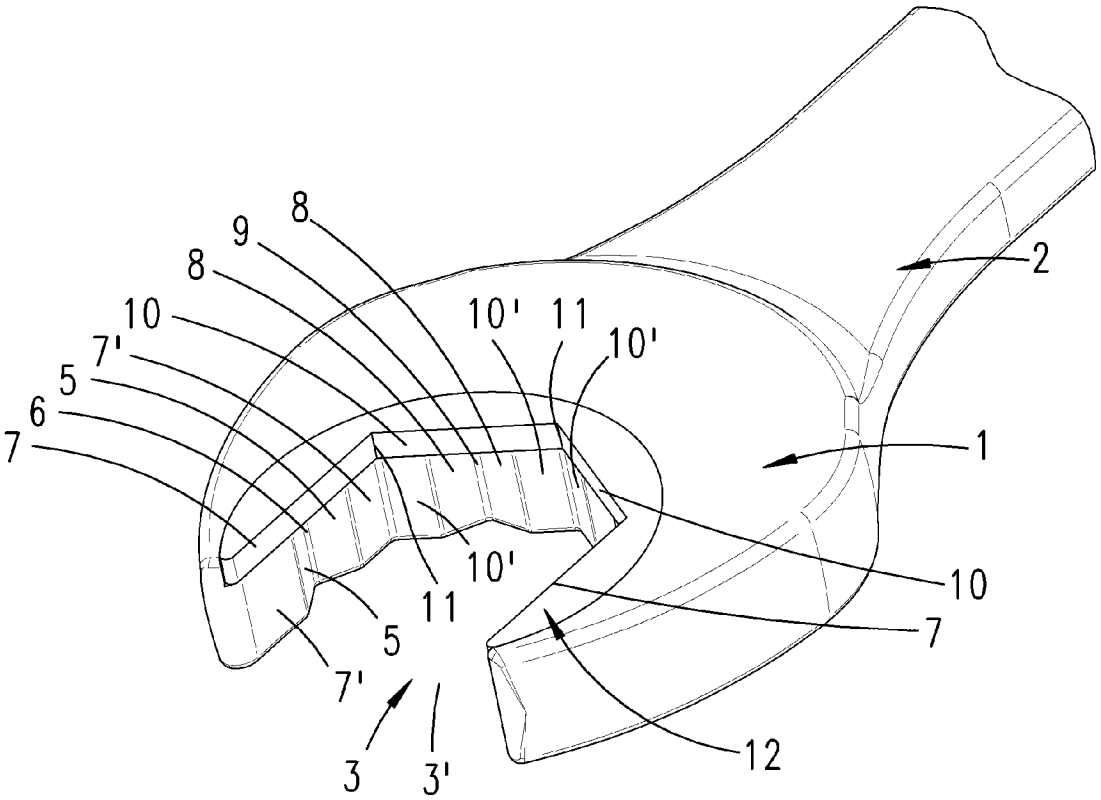
FIG. 2 shows an illustration corresponding to FIG. 1, but with the tool turned through 180°.

The tool shown in the drawings consists of a steel base body, which has a head 1 and an actuating arm 2 integrally connected to the head 1. The actuating arm 2 is shown only in part for clarity of illustration. One of the two wide sides of the head 1, which consists of a flat material, is provided with a profiled steel plate 12. While the steel base body can be forged from a steel with a hardness from 39 to 49 HRC, the steel plate 12 is a hardened plate. The profile opening can be produced, for example, by stamping or broaching. The steel plate 12 shown in the drawings has a peripheral contour that runs on a circular arc and is enclosed in a recess in the wide side of the head 1. The steel plate 12 may however also have a different peripheral shape, in order for example for it to be positively secured against twisting. It is conceivable for the steel plate 12 to be connected to the steel base body by screws, for the steel plate 12 to be welded to the steel base body, or for it to be adhesively bonded thereto.

The radial jaw opening 3' of the steel plate 12 has the shape of a partial section of an equilateral hexagon, the spacing of two mutually opposite jaw cheeks 7 which are substantially parallel to one another defining the wrench dimension of the tool. The jaw opening 3' located between the substantially parallel jaw cheeks 7 forms a mouth, which is open to one side. The jaw opening 3' has substantially at least the width of the wrench dimension, thus the spacing between the two substantially parallel jaw cheeks 7.

The other of the two wide sides of the head 1 which is made of the steel base body has jaw portions 7', which run in alignment with the jaw cheeks 7. In the apex lines 11, which are preferably formed as rounded portions in order to avoid notch stresses, the jaw cheeks 7 run into cheeks 10 which can enter into face-to-face engagement with the hexagon surfaces 14 of a nut 13, in the same way as the jaw cheeks 7, when the nut 13 is inserted into the mouth. The hexagon corners 15 of the nut 13 are then located substantially close to the apex lines 11.

Figure 10:
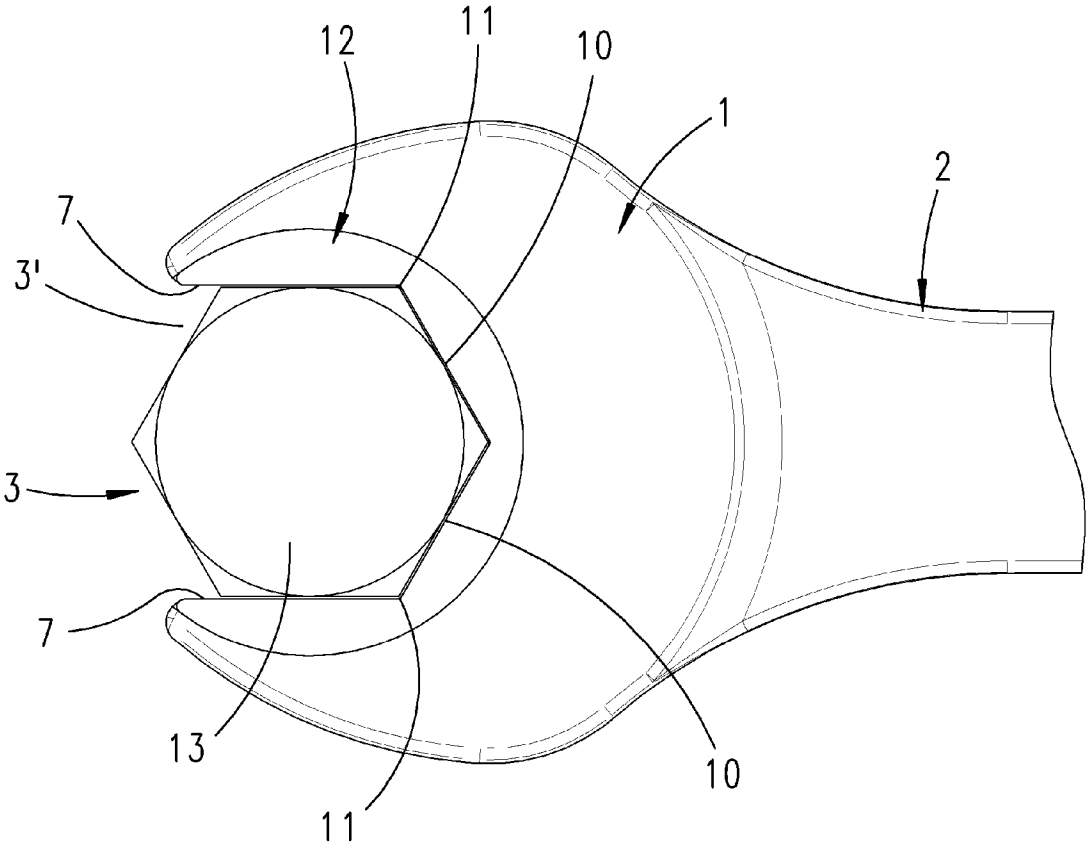
FIG. 10 is an illustration following on FIG. 9, with the hexagon shape inserted fully into the jaw.
Figure 11:
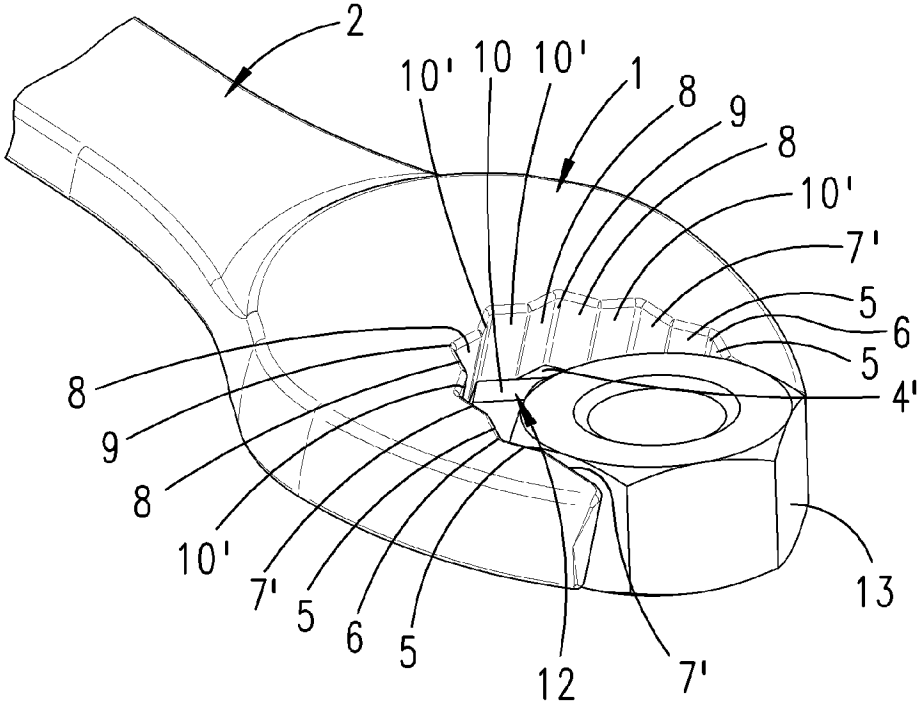
FIG. 11 is an illustration corresponding to FIG. 8, in the second angular position.

In this angular position, illustrated in FIG. 10, the jaw portions 7' of the steel base body that are also aligned with the jaw cheeks 7 engage against the hexagon surfaces 14 of the nut 13. The same is the case for the jaw portions 10' of the steel base body that are aligned with the cheeks 10.

Approximately midway between the apex lines 11 and the jaw opening 3' of the mouth, there is an angular notch between the two jaw portions 7' of substantially the same size. This is defined by two flanks 5, which meet in an apex line 6, and a further flank 4, which is formed by the underside of the steel plate 12. The angular notch of this kind is associated with each of the two diametrically opposed jaw cheeks 7.

Also another angular notch that is flanked by the jaw portions 10' of the steel base body is associated centrally with the two cheeks 10, each of which runs at an angle of 120° to the jaw cheeks 7. Each of the two angular notches is formed in first instance by two flanks 8 that meet at an angle of 120° in an apex line 9, and which form zones for introducing torque in the same way as the flanks 5. A third flank is also formed here by the rear of the steel plate 12. In the same way as the flank 4, a flank 4' forms a stop for a wide side portion 16 of the end of the nut 13.

Figure 3:
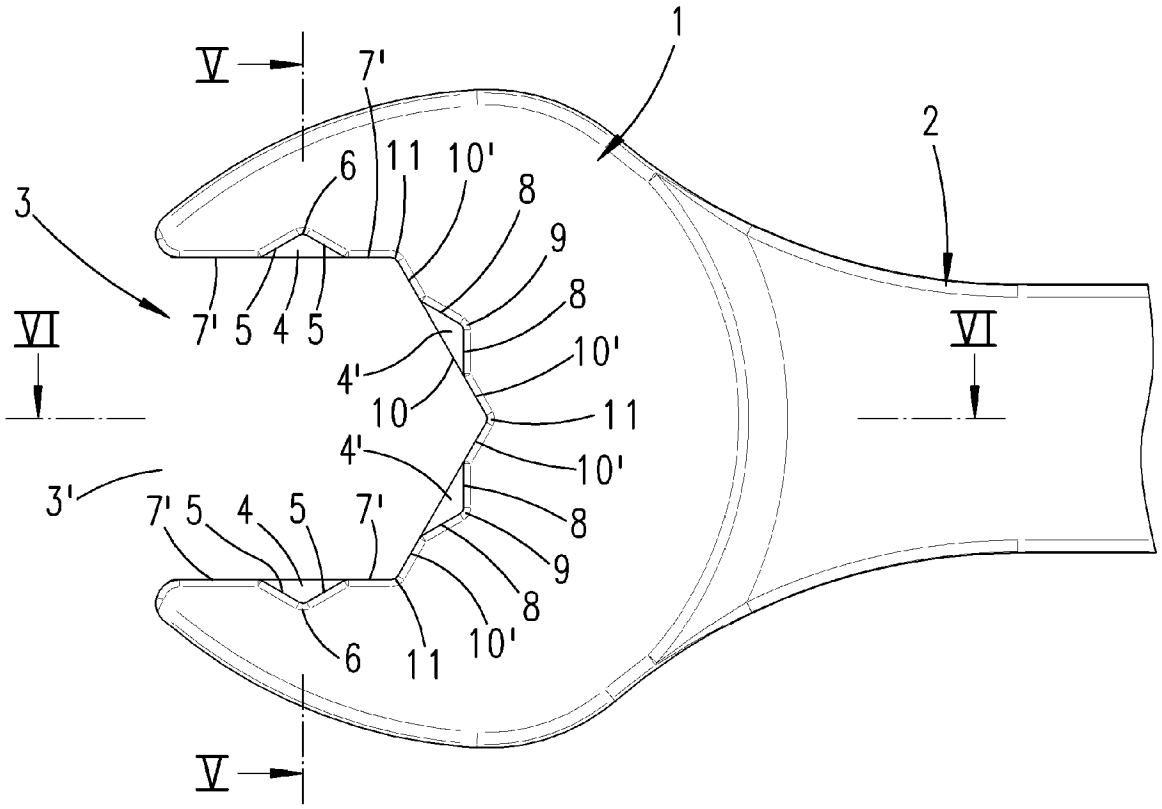
FIG. 3 shows a top view of the tool illustrated in FIG. 1.
Figure 4:
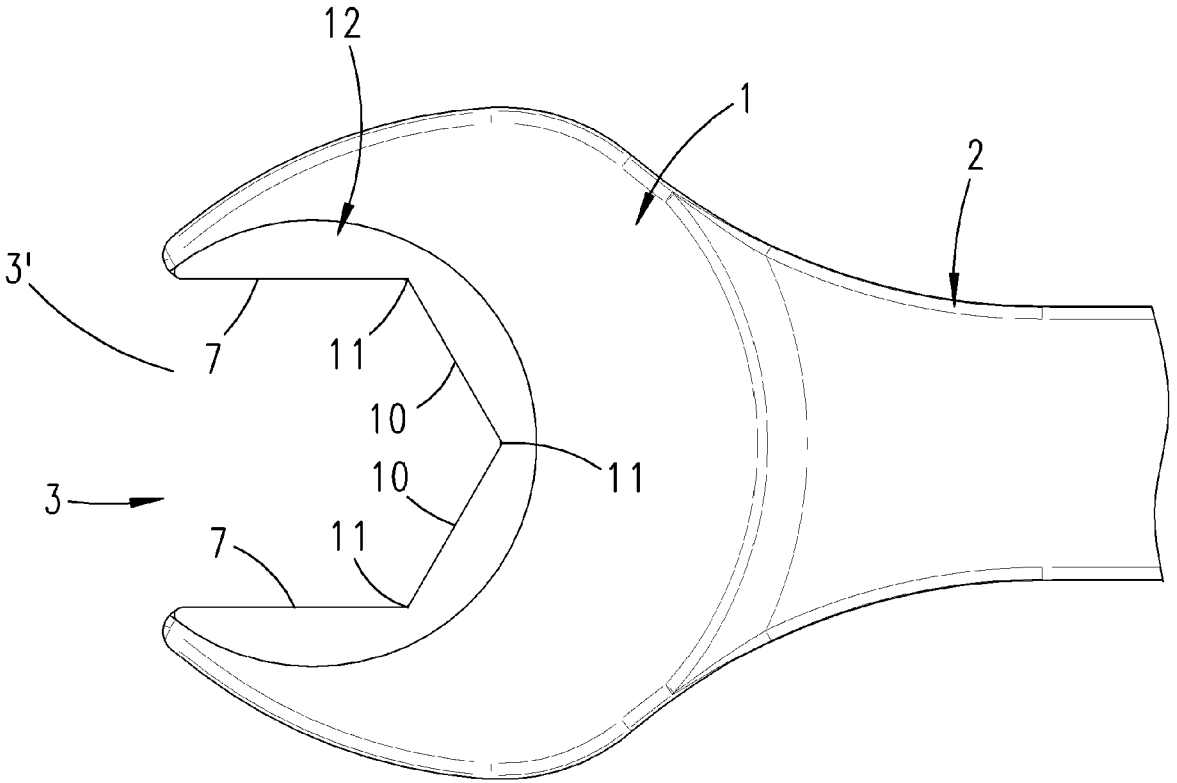
FIG. 4 shows the rear view of the tool.
Figure 5:
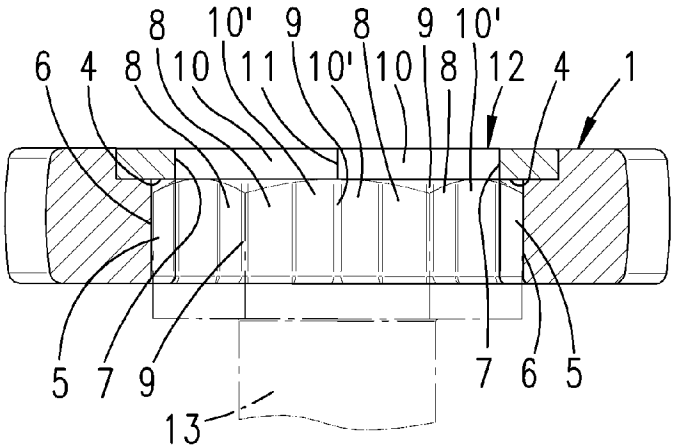
FIG. 5 shows a section on the line V-V in FIG. 3.
Figure 6:
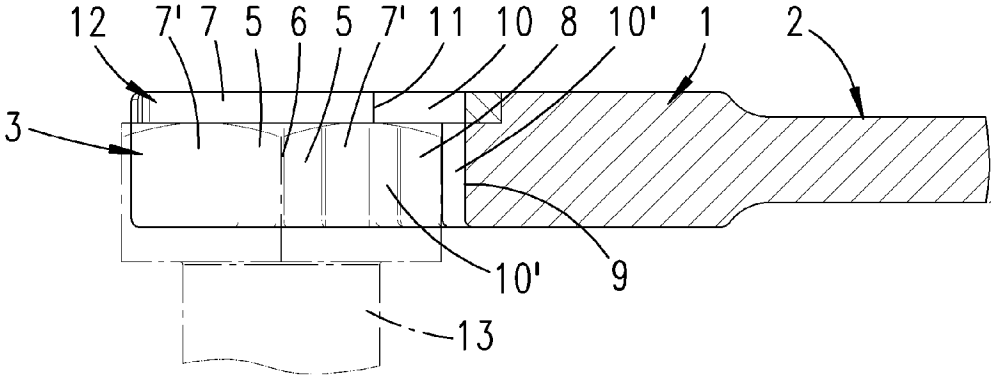
FIG. 6 shows a section on the line VI-VI in FIG. 3.
Figure 4:
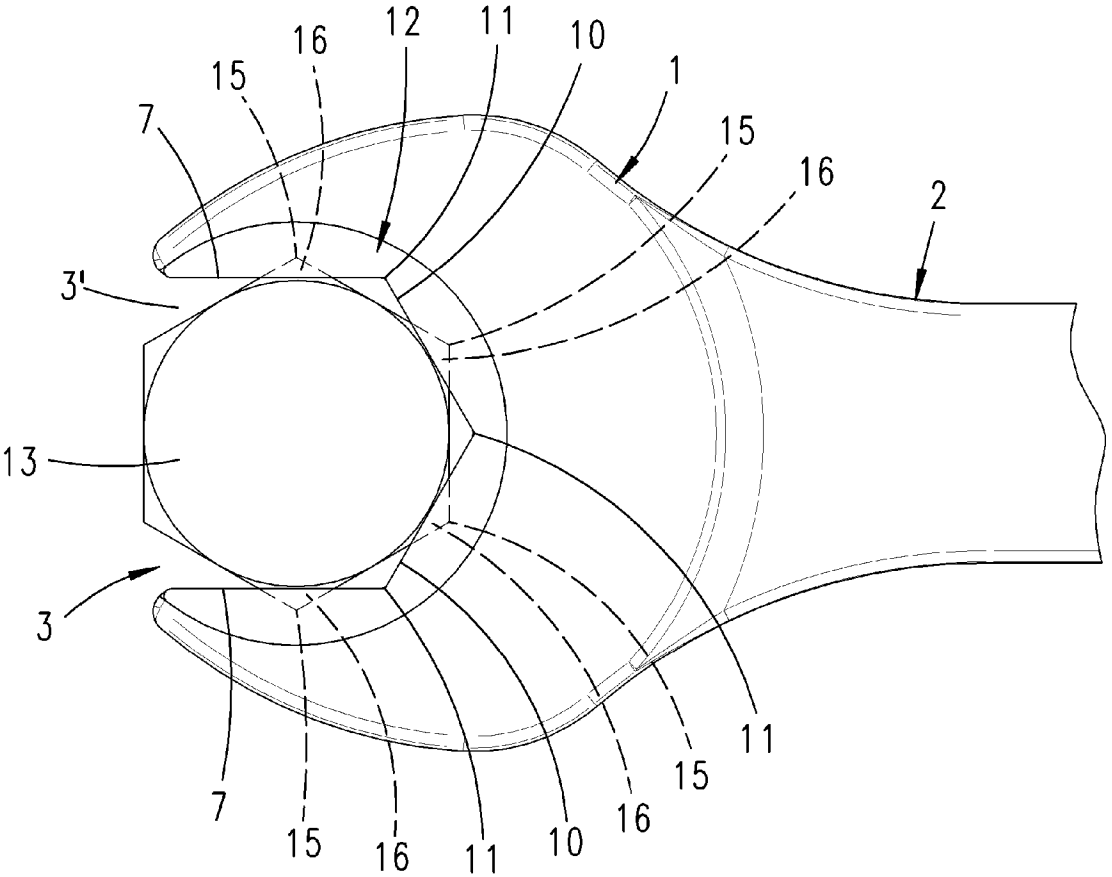

As can be gathered from FIG. 3, the polygonal jaw surface 5 is aligned with the polygonal jaw surface 8. The flanks 5 and 8 of the angular notches are in the region of the corners of an equilateral hexagon that has a spacing between its sides which corresponds to the spacing between the jaw cheeks 7. The flanks 5 and 8, together with the jaw portions 7' and 10' defines an inward opening 3 having a multi-point configuration.

Figure 12:
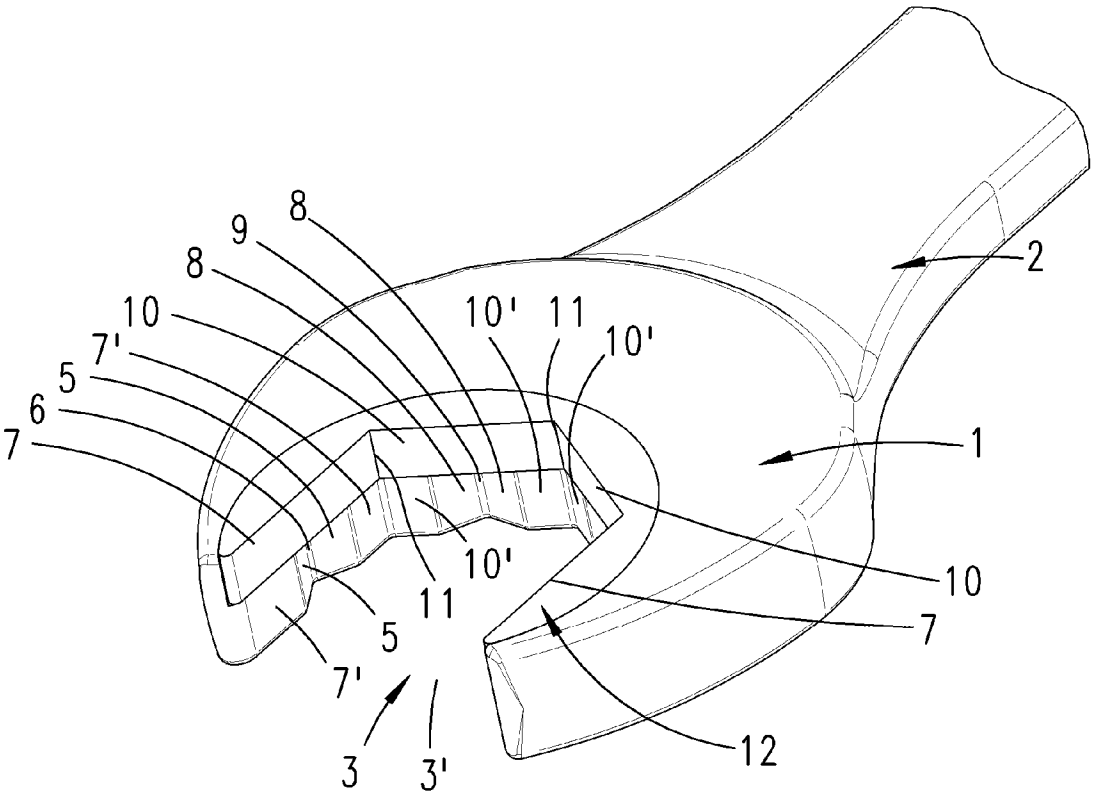
FIG. 12 is an illustration corresponding to FIG. 2, of a second embodiment.

The second embodiment shown in FIG. 12 differs from the first embodiment substantially in that the steel plate 12 extends over approximately half of the thickness of the material of the head 1. Also in this embodiment, the steel plate 12 is inserted interchangeably in a recess in the wide side of the head 1. Securing is effected by screws, not shown, which establish a connection between the steel base body and the steel plate 12, from one of the two wide sides. Preferably the steel plate 12 is enclosed in a recess in the head 1 of the wrench. It is however also conceivable for the steel plate 12 to extend over the entire wide side of the steel base body. In this case, the thickness of the material of the steel base body is preferably the same as the thickness of the material of the steel plate 12.

The thickness of the material of the steel plate 12 may however also be selected so that the axial extent of the jaw cheeks 7 is greater than the axial extent of the multi-point configuration defined by the flanks of 5, 8. Likewise the steel plate 12 may be configured so that the axial extent of the jaw cheeks 7 is less that the axial extent of the multi-point configuration defined by the flanks of 5, 8.

The wrench according to the invention has two zones for introduction of torque that are located beside one another in the axial direction, the first zone for introduction of torque, which is formed by the multi-point configuration defined by the flanks of 5, 8, being produced on the basis of a twelve-point box-end wrench profile. The box-end wrench profile is provided with a ring opening, which is however larger than in the case of an open box-end wrench in accordance with DIN standards. The mouth opening has a width which corresponds to the width of an open-end wrench. The second zone for introduction of torque is formed by an open-end wrench profile. The two zones for introduction of torque are located one above the other in such a way that the two opposed parallel cheeks of the open-end wrench form abutments for end face portions of the hexagon cross-section of a nut or a bolt head.

Figure 13:
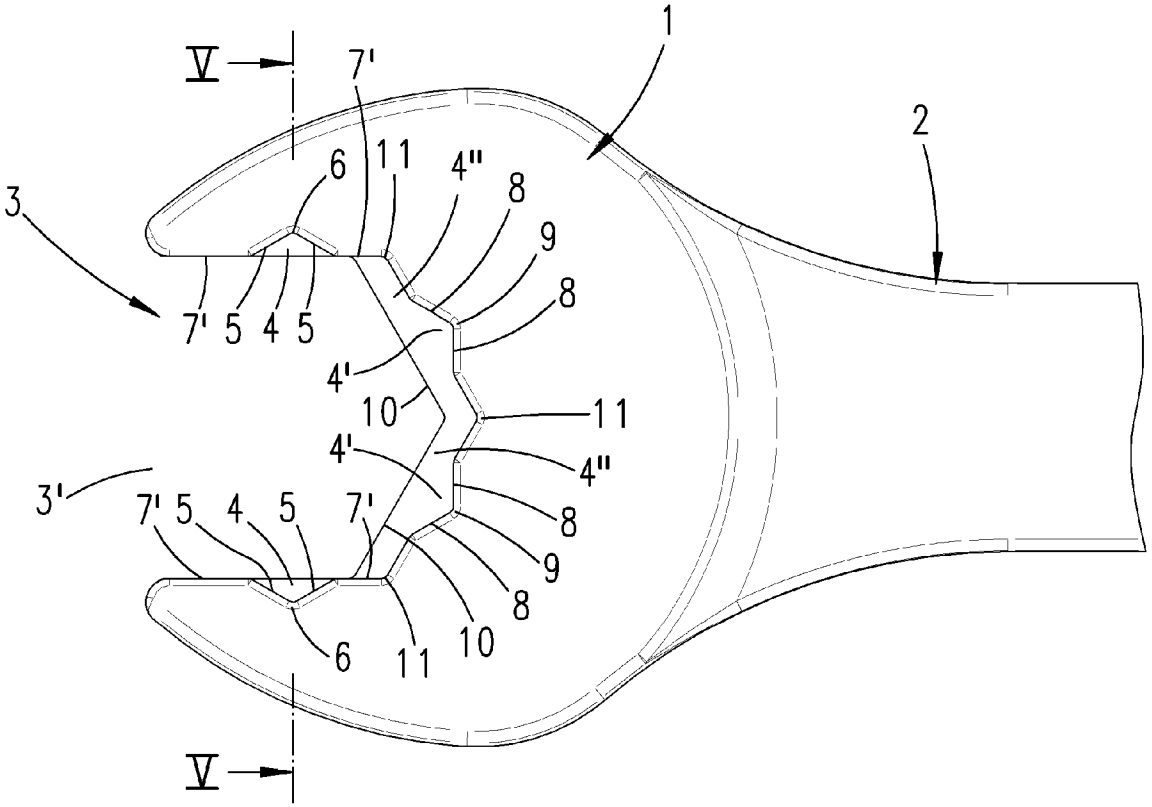
FIG. 13 is an illustration corresponding to FIG. 3, of a third embodiment.
Figure 14:
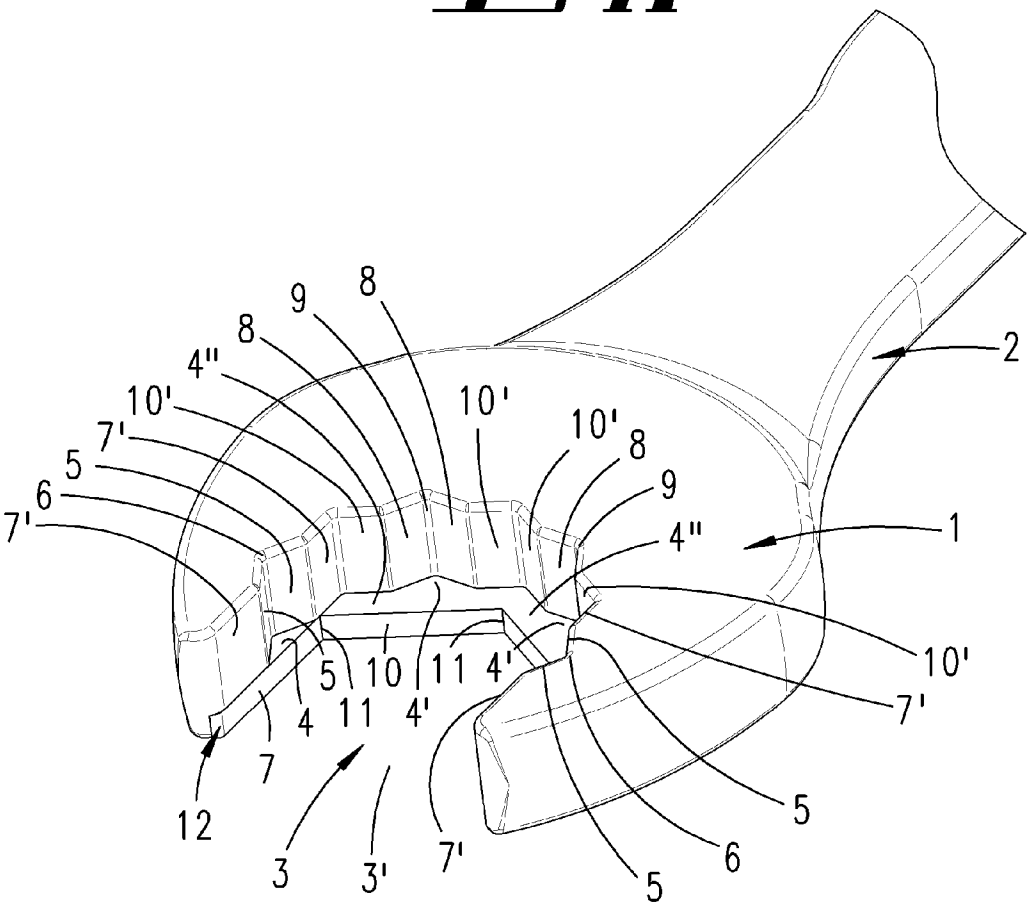
FIG. 14 is an illustration corresponding to FIG. 1, of the third embodiment.

In the case of the third embodiment shown in FIGS. 13 and 14, the two jaw cheeks 7 that are opposite one another and the two cheeks 10 that run towards one another in the shape of a V form the jaw opening 3' to a lesser extent than is the case in respect of the first embodiment shown in FIG. 3. This has the result that in an operating position in which two opposed flats of the nut 13 engage in face-to-face manner on the jaw cheeks 7 and the jaw portions 7', two edge regions of the flat faces of steps 4", which are formed by the rear of the steel plate 12, are also overlaid. In an operating mode in which the hexagon corners 15 of the nut 13 are enclosed in the angular notches formed by flanks 5 and the apex line 6, greater areas of the end face of the nut 13 are overlaid than is the case for the first embodiment. Furthermore, the steps 4' also form stops against which the end face portion of the nut 13 impacts, when the polygonal sides of the nut 13 engage in face-to-face manner against the jaw cheeks 7.

Figure 15:
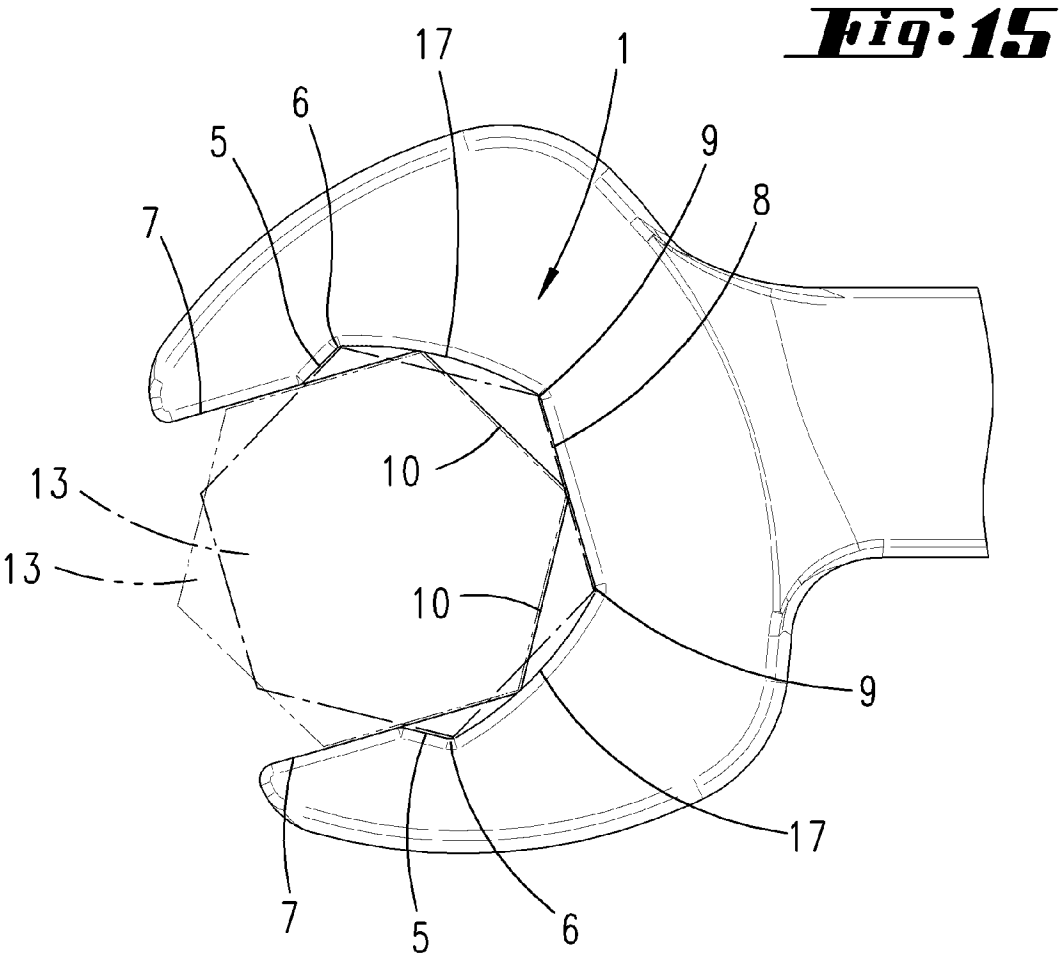
FIG. 15 is a illustration of a fourth embodiment in an illustration corresponding to FIG. 3.

For the fourth embodiment shown in FIG. 15, the flanks 5 of the multi-point arrangement of the steel base body run in each case into an arcuate portion 17, in the apex line 6. The two arcuate portions 17 merge at the apex lines 9 into a rearward jaw surface 8' which locates opposite to the jaw opening and extends substantially at right angles to the direction of extent of the two jaw cheeks 7.

The nut 13 is shown in dashed lines in this embodiment, this engaging against flanks 5 of the steel base body by way of two diametrically located corner regions. Since the two flanks 5 that are spaced apart from one another by the wrench width lie on lines which intersect one another in front of the inward opening 3, these flanks 5 form radial retaining flanks. In opposition to the flanks 5, there runs the rearward jaw surface 8' formed by the mouth base of the steel base body.

The nut 13 is also shown chain-dashed in FIG. 15, which engages against the jaw cheeks 7 of the steel plate 12 by way of two flats that face away from one another. An edge of the nut 13 facing the mouth base engages centrally against the rearward jaw surface 8'. The shape of the steel base plate 12 corresponds substantially to that of the first embodiment.

Furthermore, it may be provided that the polygonal jaw configuration is based on a 24-sided profile. In addition, the flanks 5, the rearward jaw surface 8' and the parallel cheeks 7 and the jaw portions 7' do not have to run in a straight line. These surfaces 5, 8, 7, 7' may also lie on arcuate lines with a large radius of curvature. Both surface profiles that lie one above the other in the axial direction may be formed by a sequential arrangement of arcuate portions.

In addition, the jaw cheeks 7 may be formed to be rough. They may be ribbed. They may be provided with a diamond coating or another frictional coating. The surfaces of the jaw cheeks 7 may furthermore also be toothed.

Figure 8:
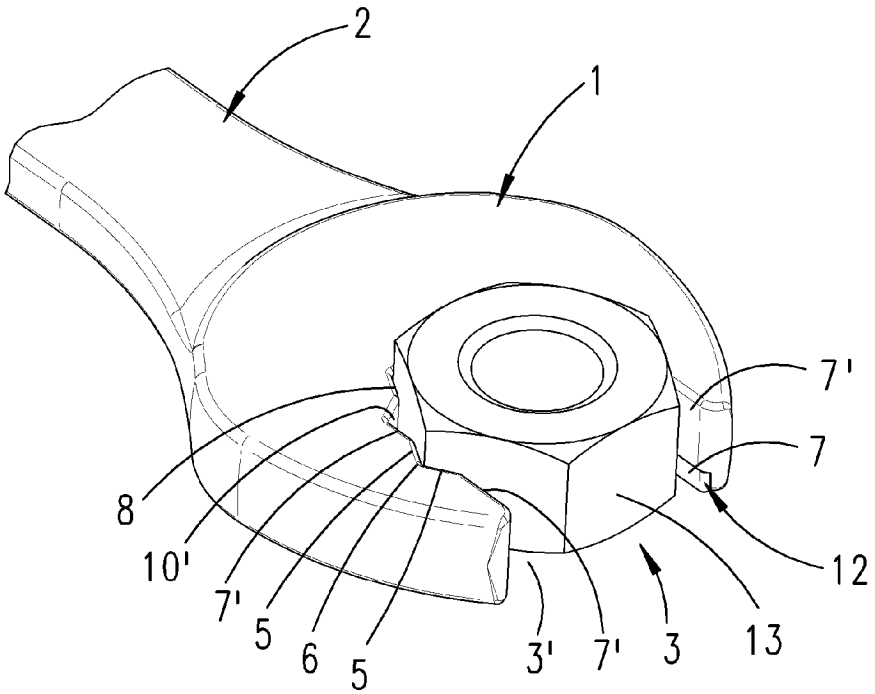
FIG. 8 shows a perspective rear view of this.

The manner of working of the tool is as follows:

A nut, as is illustrated in FIG. 8, has an axis about which it may be rotated. This nut may interact with the tool in two different angular positions which are displaced from one another by 30°. In a first angular position, which is shown in FIGS. 7 and 8, the nut 13 must be inserted in the axial direction from the side that faces away from the steel plate 12, between the flanks 5, 8 of the inward opening 3. In this way, there are altogether four of the hexagon corners 15 of the nut 13 reside in the four angular notches formed by the flanks 5 and 8. The hexagon corners 15 of the nut 13 then correspond to the apex lines 6, 9 of the angular notches.

The axial insertion of the nut 13 into the inward opening 3 of the wrench or the axial placement of the inward opening 3 onto the nut 13 is effected in a stop-limited manner. The flanks 4, 4' formed by the underside of the steel plate 12 serve as a stop, these engaging on wide side portions 16—as shown by FIG. 7.

Figure 9:
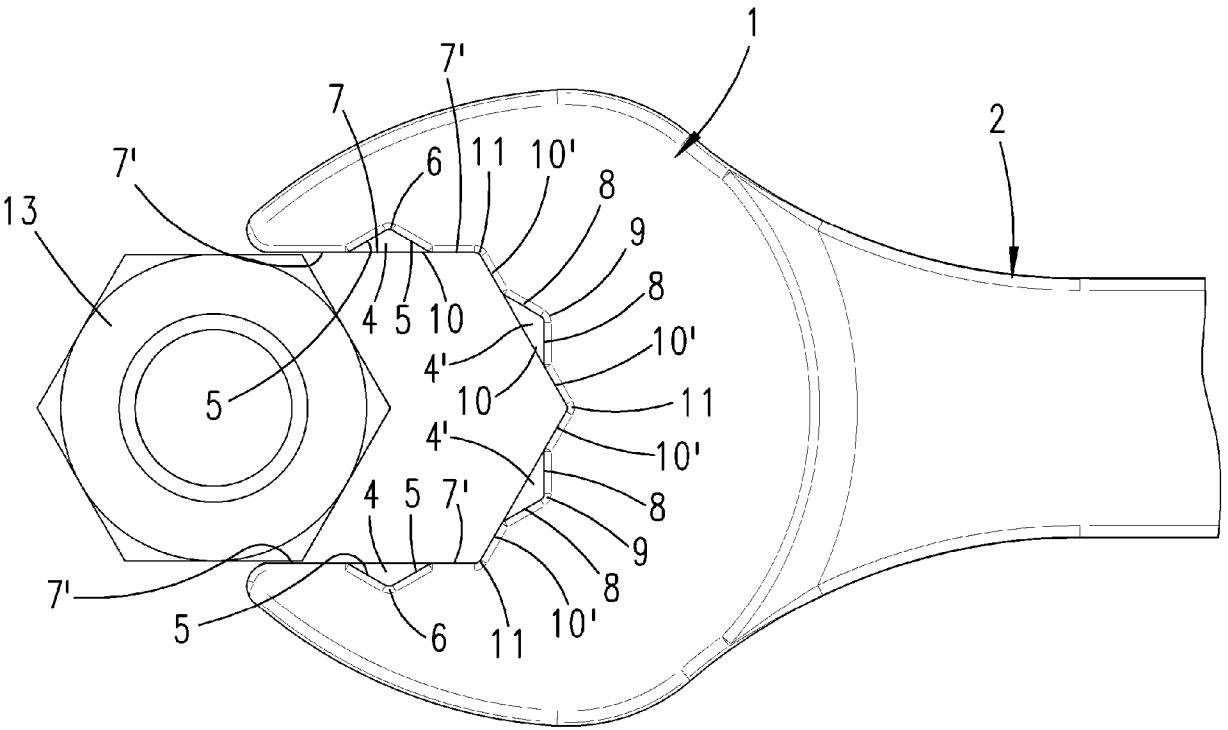
FIG. 9 shows the wrench in the position illustrated in FIG. 3 with the jaw pushed in part onto the hexagon surfaces of a bolt head.

In a second mode of operation of the tool, the jaw opening 3'—as is shown in FIG. 9—is pushed onto the hexagon surfaces 14 of the nut 13, in the radial direction with respect to the axis of rotation of the nut 13. In this way, not only the jaw cheeks 7, but also the jaw portions 7' that run aligned with the jaw cheeks 7, slide along the hexagon surfaces 14 of the nut 13, until the end position shown in FIG. 10 is reached, in which a total of four hexagon surfaces 14 engage against corresponding surfaces 7, 10 and 7', 10'.

In an embodiment which is not illustrated, the cheeks 10 and the flanks 8 are left out. The portion opposite the opening of the mouth, thus the base of the jaw, runs in this embodiment on an arcuate line through the apex lines 9 and the apex lines 11 shown in the drawings.

Figure 16:
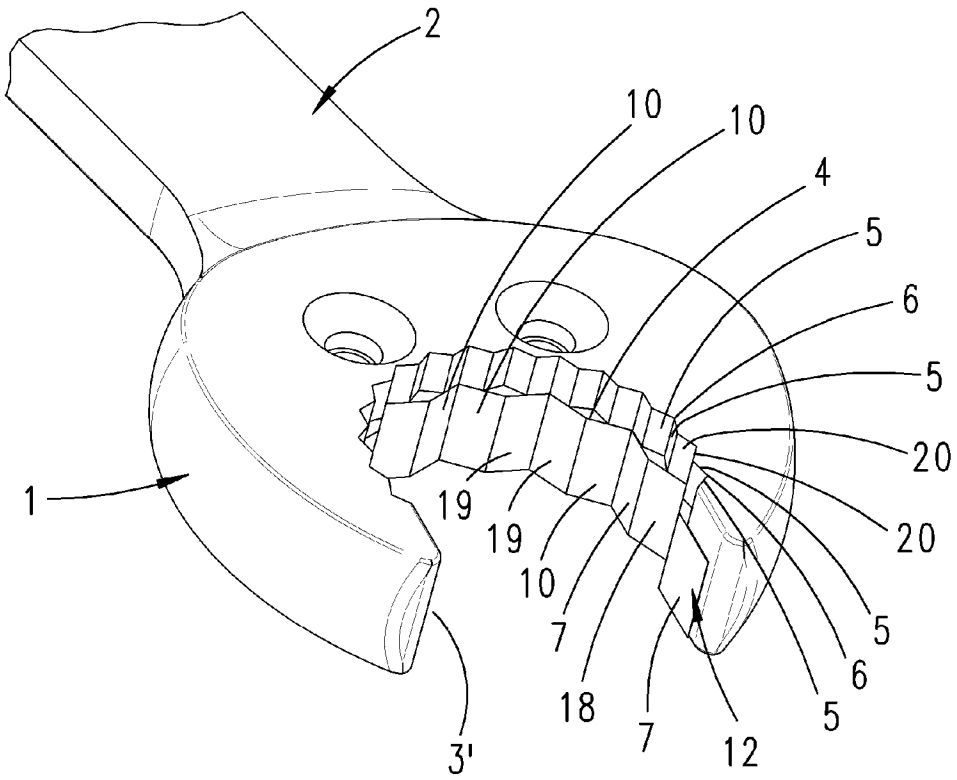
FIG. 16 is a first perspective illustration of a fifth embodiment.
Figure 17:
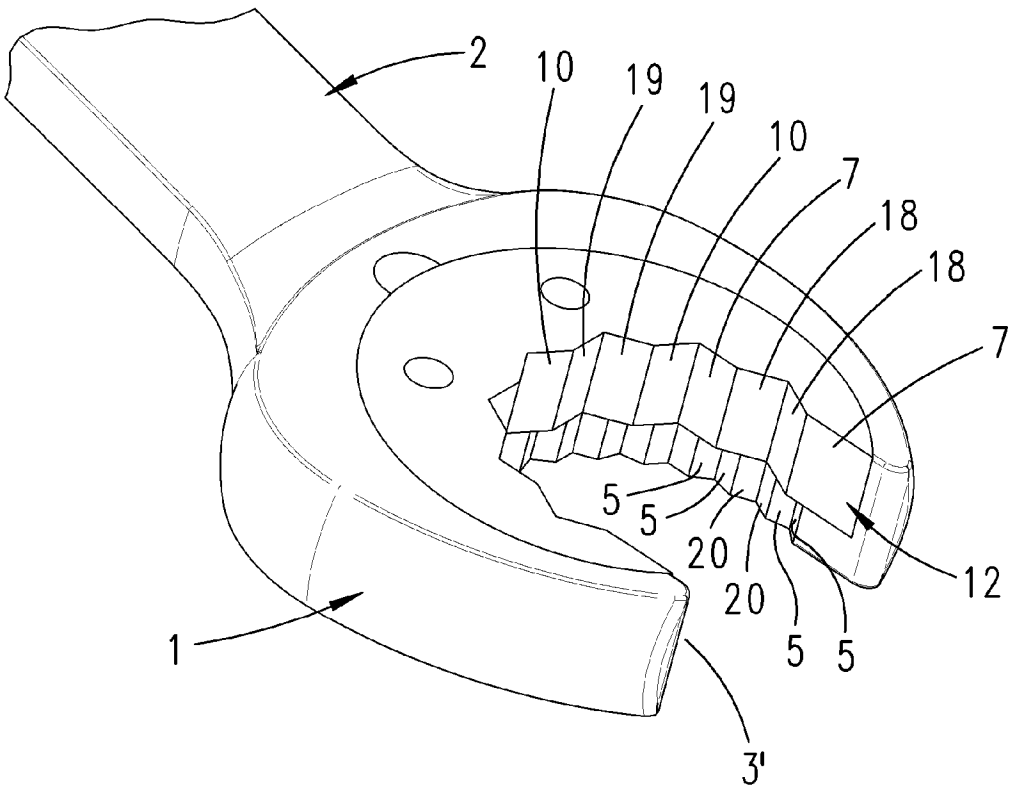
FIG. 17 is a second perspective illustration of the fifth embodiment.
Figure 1B:
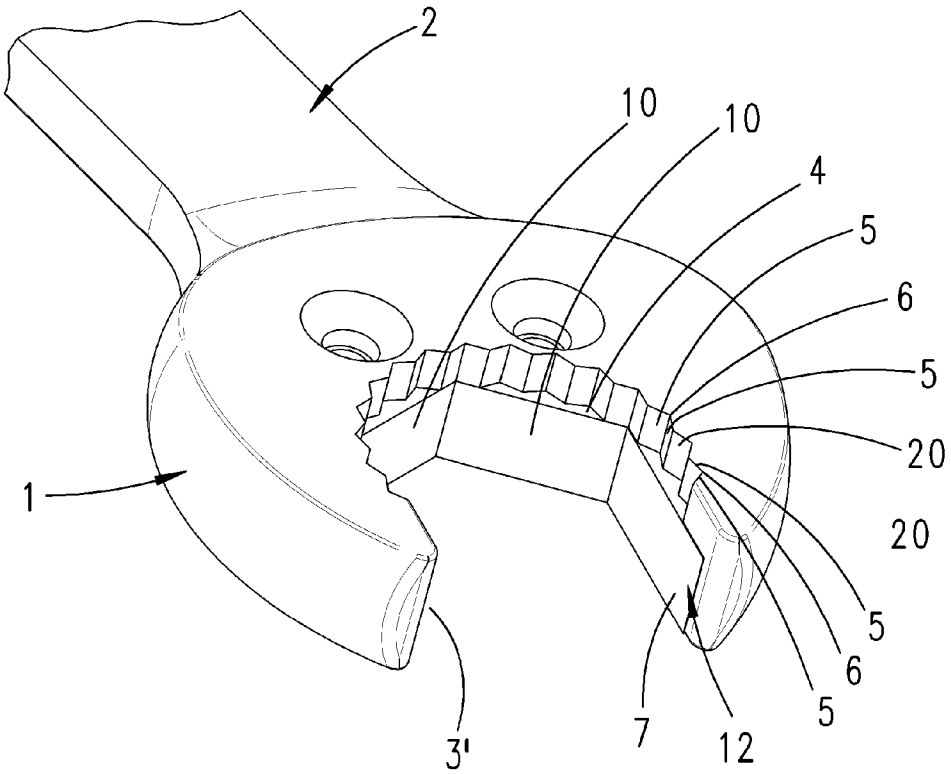

For the fifth embodiment shown in FIGS. 16 and 17, the open-end wrench profile formed by the steel plate 12 has the contour in plan view of a twelve-sided polygon. Here also the jaw cheeks run as jaw cheeks 7 that extend parallel to one another. The jaw cheeks 7 that run parallel to one another are however interrupted centrally. They form there two opposed angled openings, which are defined by two polygon surfaces 18 of the twelve. Also the cheeks 10 of a hexagonal profile that extend within the jaw base are in each case interrupted centrally by polygon surfaces 19 of a twelve-sided profile.

The multi-point profile that is disposed axially displaced with respect to the open-end wrench profile has, in this embodiment, the shape in plan view of a 24-sided polygon.

The flanks 5 provided with the flanks 4 are in the case of this embodiment neighbored by 24-edge jaw surfaces 20, which are in alignment with the polygon surfaces 18 and 19 of the open-end wrench profile. In the case of this embodiment, a nut can be inserted radially into the opening 3'. The wrench may however also be placed radially onto a nut or a screw head in a 30°-displaced position relative to this, with the hexagon corners 15 of the nut 13 entering into the angle portions formed by surfaces 19, 18 and 20. In the case of this manner of gripping, the flanks 4 do not come into play. The flanks 4 in this case fulfill their stop function when the bolt head or the nut is inserted radially into the multi-point arrangement in a 15°-displaced position.

Figure 19:
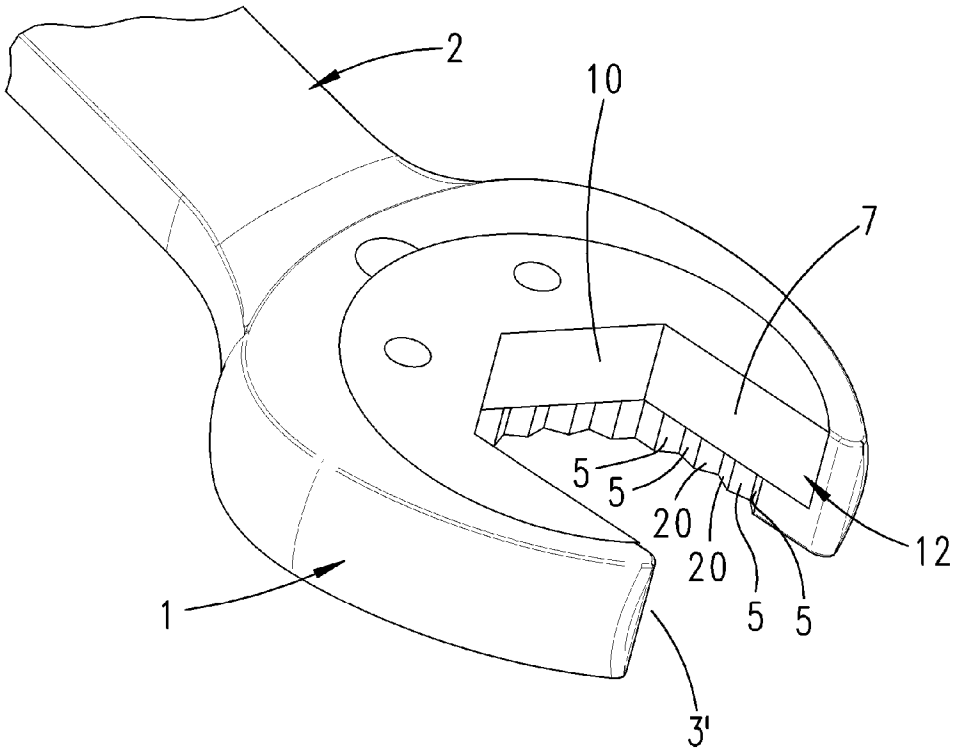
FIG. 19 is a second perspective illustration of the sixth embodiment.

In the case of the seventh embodiment shown in FIGS. 18 and 19, the open-end wrench profile is once again a hexagonal profile, consisting of two jaw cheeks 7 that run parallel to one another and cheeks 10 adjoining these at an angle of 120°. The multipoint arrangement defined by the flanks 5, 8 is based in this embodiment on a 24-edge profile. The additional jaw surfaces are indicated by the reference numeral 20. The 24-edge surfaces 20 are flanks of an angle notch whose third flank is formed by the flank 4. Three angular positions of a bolt head or nut profile are therefore possible, in each case displaced by 15°, in which an end face portion is supported on the flank 4.

Figure 20:
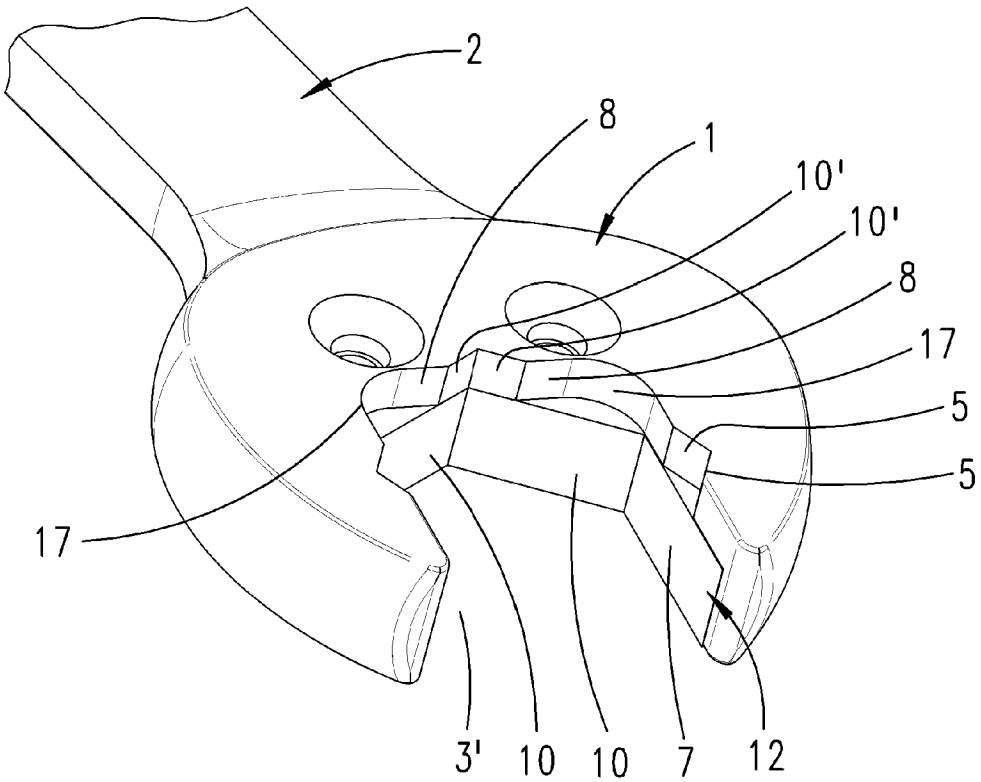
FIG. 20 is a first perspective illustration of a seventh embodiment.
Figure 21:
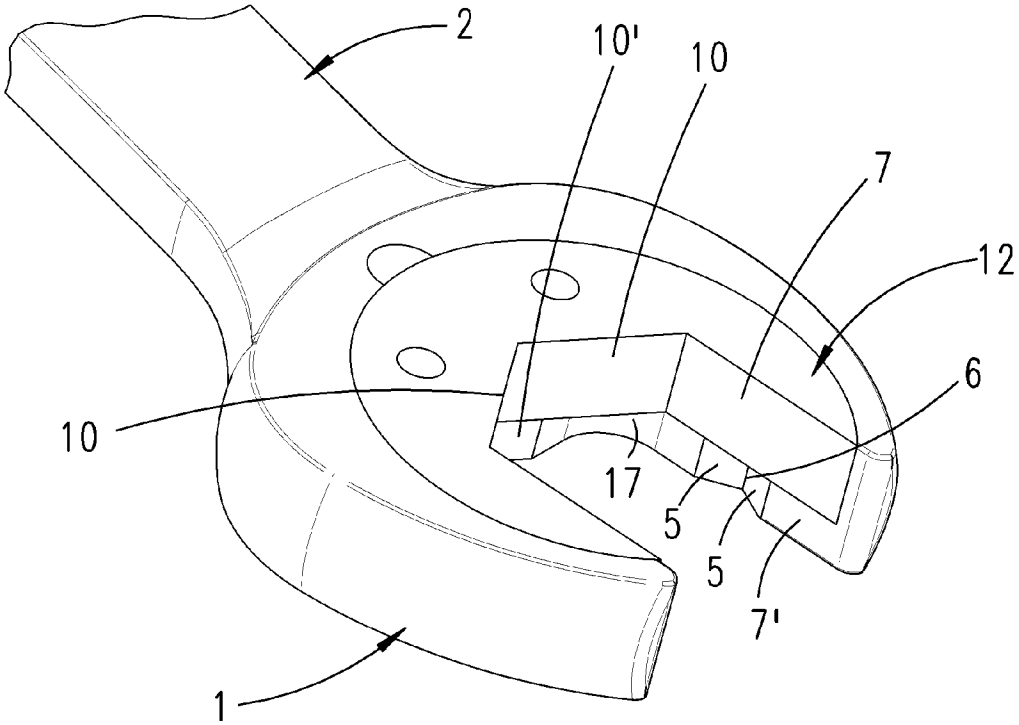
FIG. 21 is a second perspective illustration of the seventh embodiment.

In the case of the seventh embodiment shown in FIGS. 20 and 21, arcuate portions 17 lie between the jaw surfaces 5 and 8 of the multi-point arrangement.

Figure 22:
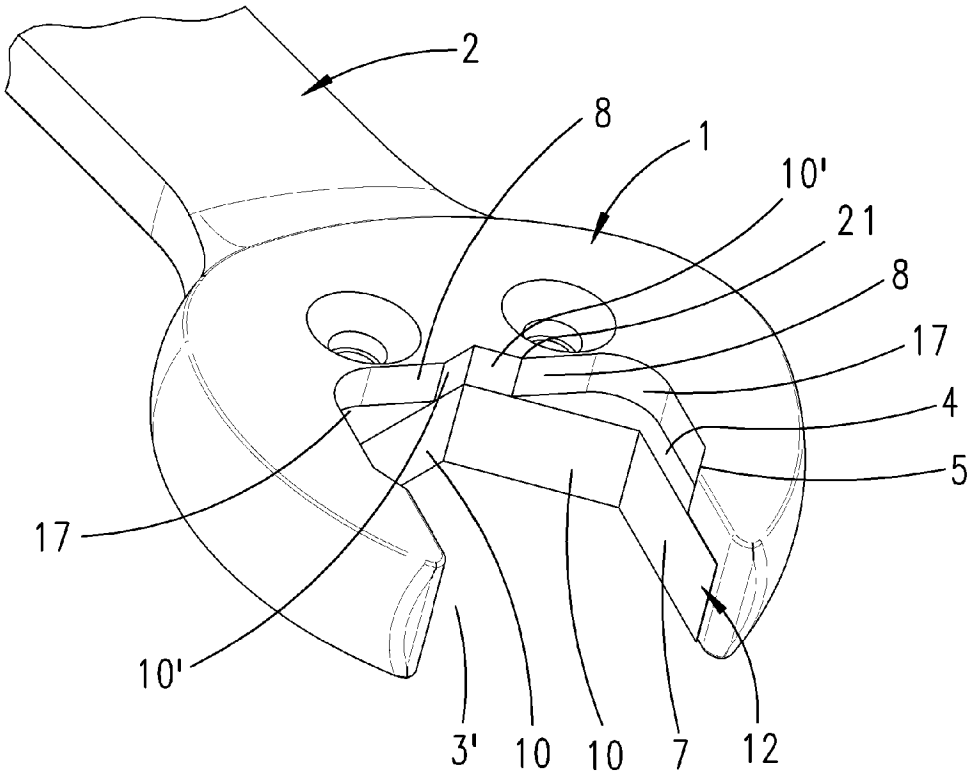
FIG. 22 is a first perspective illustration of an eighth embodiment.
Figure 23:
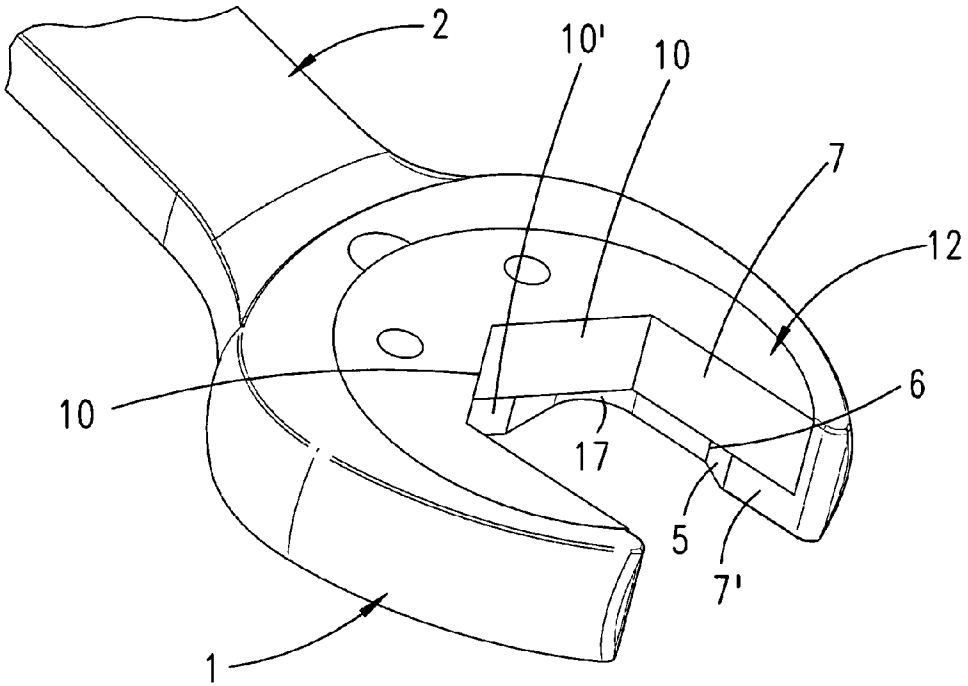
FIG. 23 is a second perspective illustration of the eighth embodiment.

The eighth embodiment shown in FIGS. 22 and 23 differs from the seventh embodiment shown in FIGS. 20 and 21 substantially in that the arcuate portions extend as far as the apex lines 6, so that the flank 4 runs in planar manner into the flank 4'.

Figure 24:
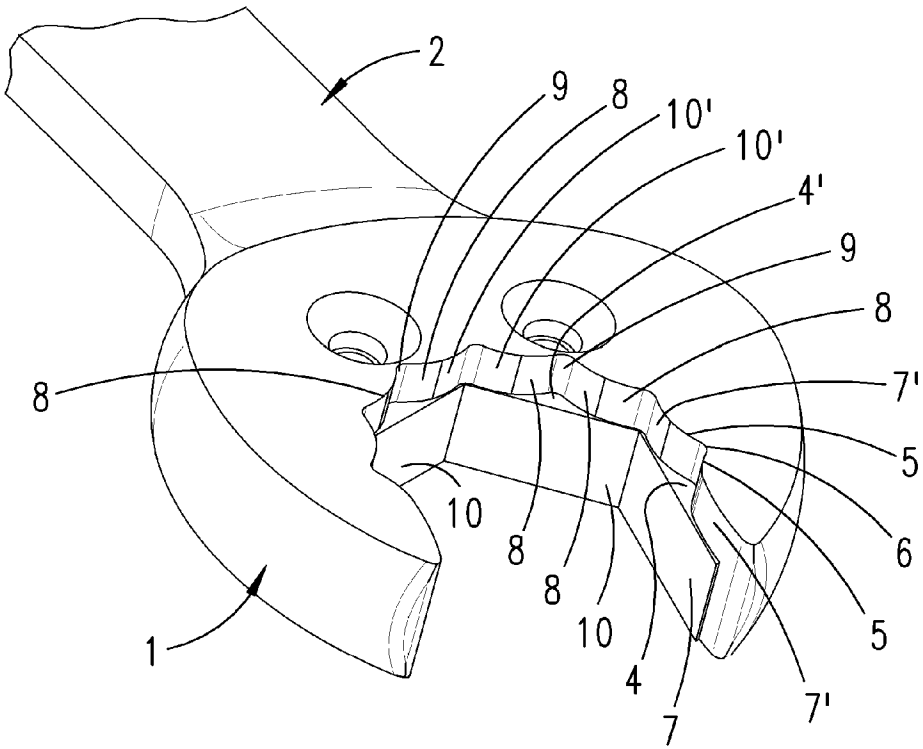
FIG. 24 is a first perspective illustration of a ninth embodiment.
Figure 25:
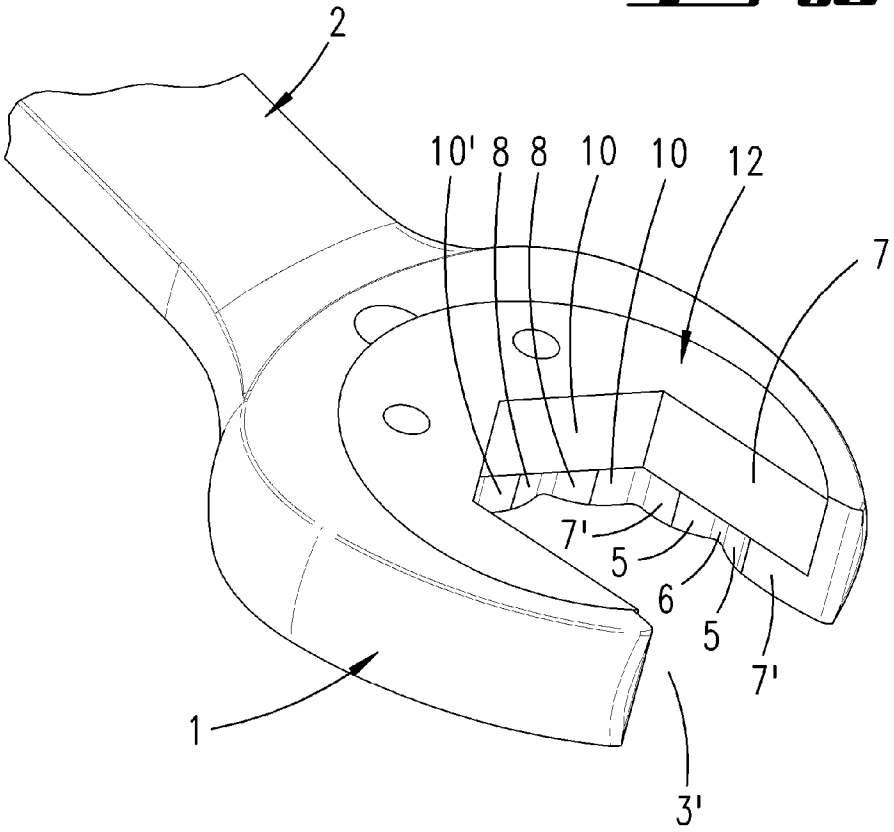
FIG. 25 is a second perspective illustration of the ninth embodiment.

In the case of the ninth embodiment shown in FIGS. 24 and 25, the jaw surfaces 5, 8 and 10' are rounded. The jaw surfaces do not run straight, but along rounded paths. The apex lines 6, 9 are also formed by radii. Surfaces and apex lines are here formed by peripheral curved regions.

Figure 26:
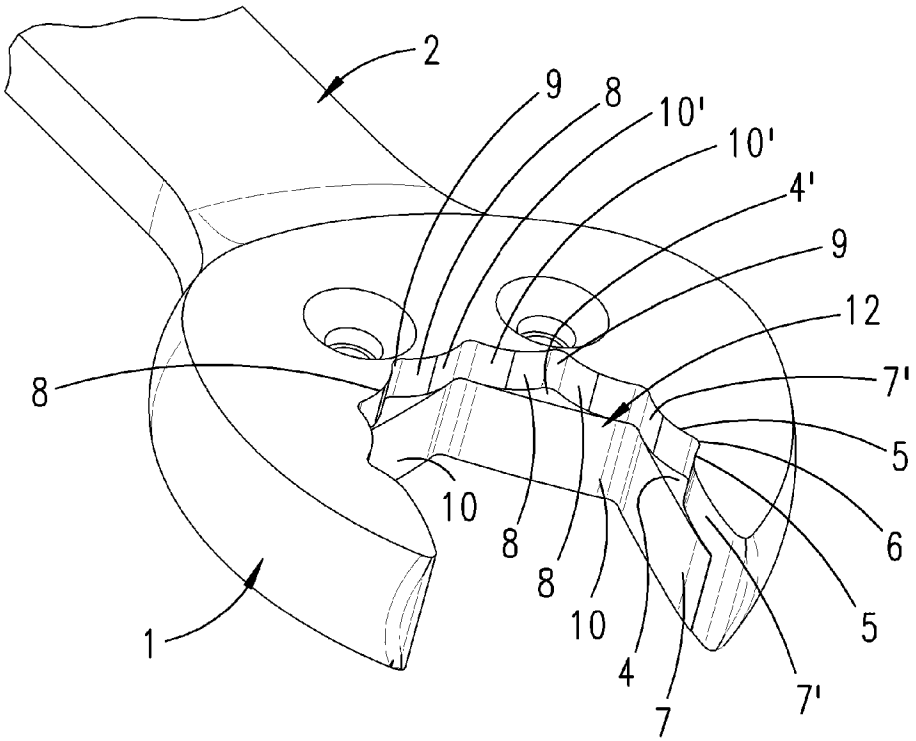
FIG. 26 is a first perspective illustration of a tenth embodiment.
Figure 27:
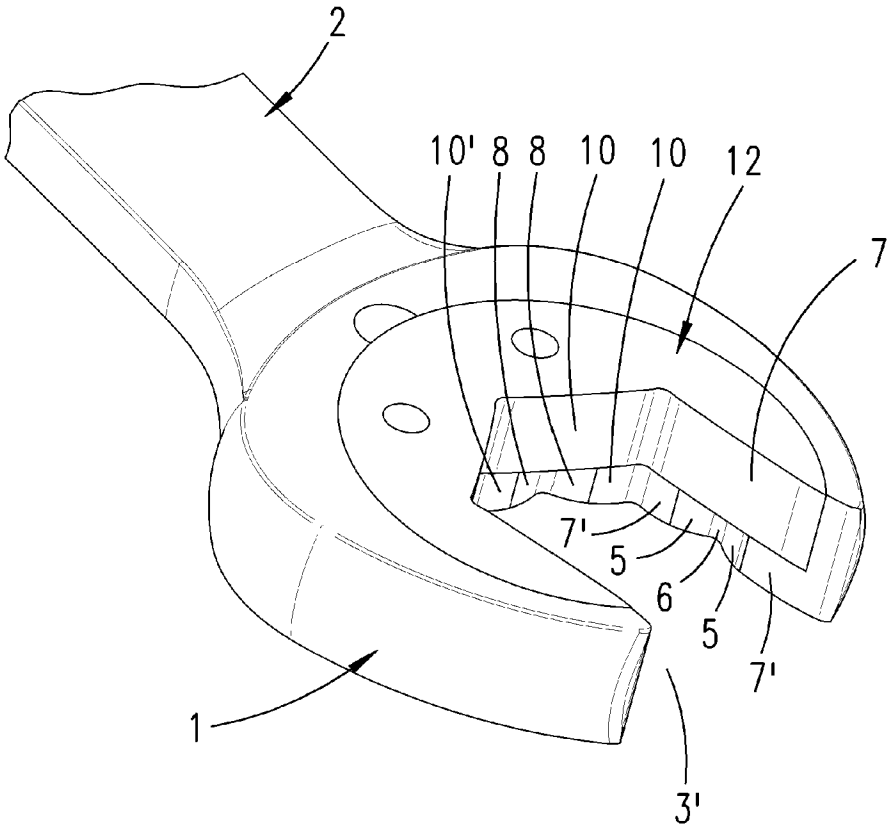
FIG. 27 is a second perspective illustration of the tenth embodiment.

In the case of the tenth embodiment shown in FIGS. 26 and 27, in addition to the ninth embodiment, the apex lines 11 between the jaw cheeks 7 and 10 of the steel plate 12 are rounded. The cheeks 7, 10 may also run on arcuate lines with a large radius.

Figures 28, 29, 30:
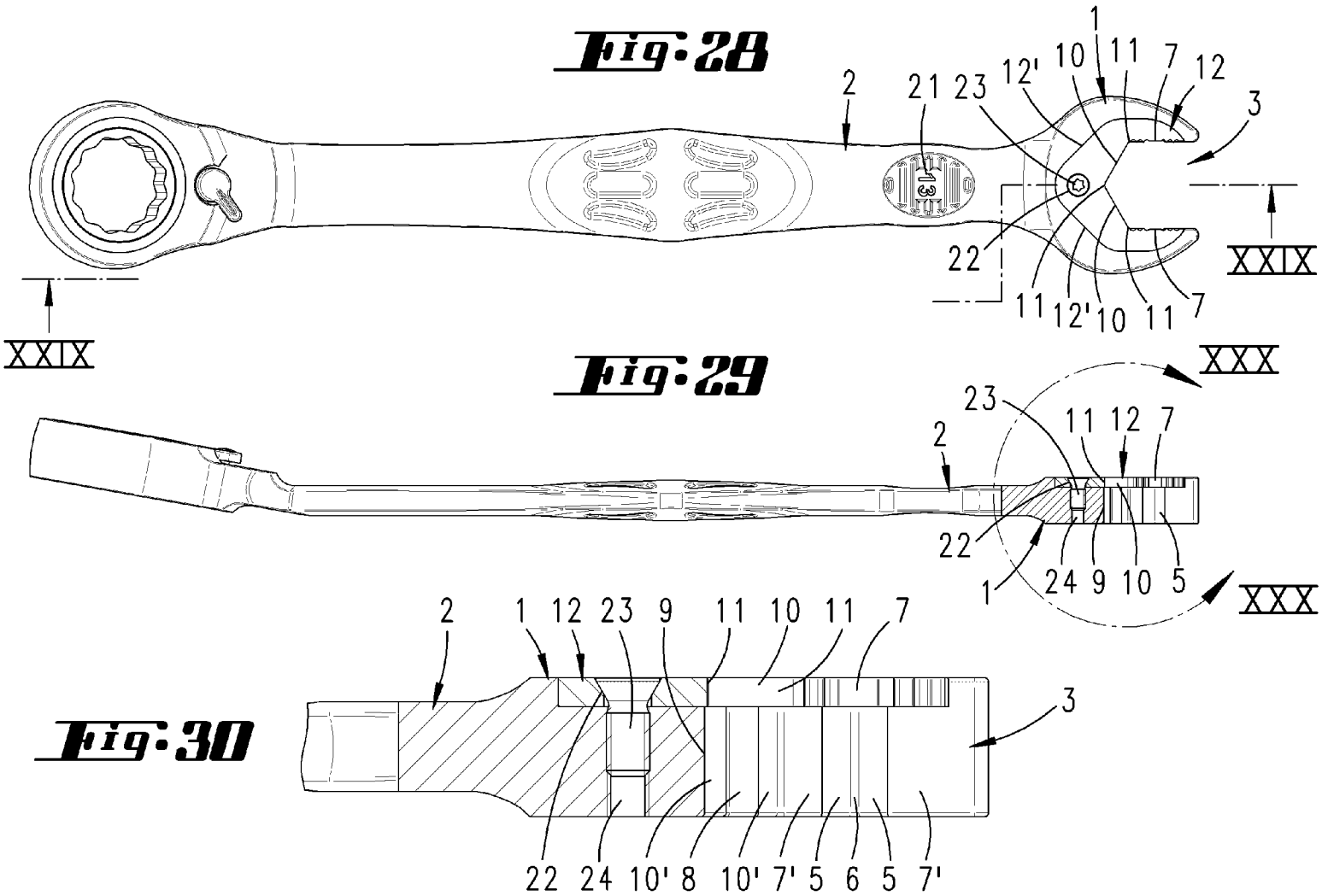
FIG. 28 shows an eleventh embodiment in top view.
FIG. 29 shows the eleventh embodiment in side view, part cut away along the line XXIX-XXIX in FIG. 28.
FIG. 30 is an enlargement of the extract XXX-XXX in FIG. 29.
Figure 31:
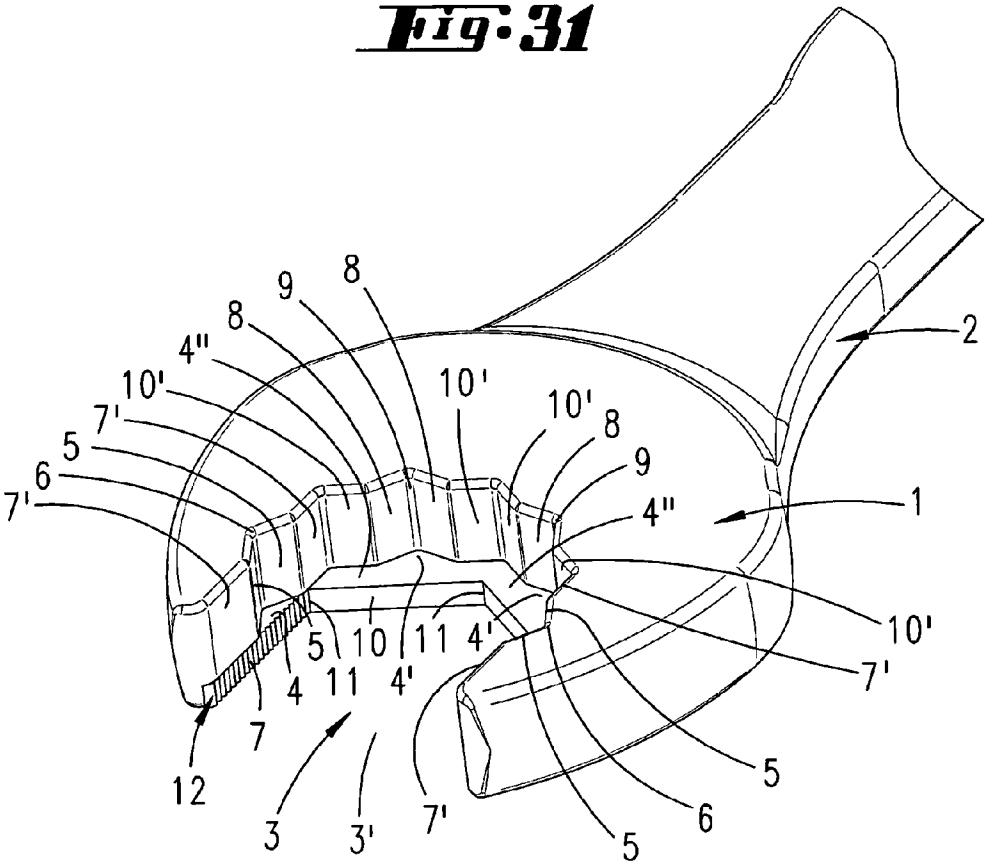
FIG. 31 shows a toothed configuration of the jaw cheeks of one embodiment.

In the case of the eleventh embodiment shown in FIGS. 28 to 30, the central gripping portion of the actuating arm 2 has a profiled outward curvature. Near the head 1, there is a dished gripping region 21 for the thumb, in which the width of the wrench is indented. Within the dished gripping region 21 for the thumb, there are moreover still protrusions of material, in order to improve the surface feel.

The steel plate 21 is secured to the head 1 by means of a screw 23, the screw 23 being inserted into a countersunk screw-securing opening 22 of the steel plate 12 and being screwed into an internal screw thread of a fixing bore 24 of the head 1. The steel plate 12 is enclosed here in a recess in a wide side of the head. Compared with the previous embodiments, the steel plate 12 only has a different shape in plan view. The outer peripheral edge of the steel plate 12 has two edge portions 12', running substantially in a straight line, which are substantially at right angles to one another and merge into one another with a rounded apex being formed. In the region of this apex, there is the screw-securing opening 22, through which the screw 23 passes.

At the end opposite from the opening 3', the acutating arm 2 carries a ratchet arrangement having a ring opening formed by a multiplicity of surfaces, the ring opening having the same width across the flats as the opening 3'. The free-running direction of the ratchet can be changed over by means of a pivot lever.

All features disclosed are (in themselves) pertinent to the invention. The disclosure content of the associated/accompanying priority documents (copy of the prior application) is also hereby included in full in the disclosure of the application, including for the purpose of incorporating features of these documents in claims of the present application.

What is claimed is:

1. A wrench comprising:

a head having a first and a second opposite wide sides, the two wide sides being displaced axially from each other; and an actuating arm being integrally connected to the head, both of the wide sides forming an opening having two cheeks running parallel and opposed to each other for torque transmitting engagement on two parallel opposed faces of a polygonal profile of a nut or a bolt head;

the two opposed cheeks forming two jaw cheeks on the first wide side and two jaw portions on the second wide side;

characterized in that the jaw portions of the second wide side are symmetrical and in alignment with the jaw cheeks of the first wide side;

wherein between the jaw portions of each of the two opposed cheeks an angular recess is located being defined by two flanks forming an angular notch and a third flank, the third flank being defined by a steel plate that forms at least part of the respective jaw cheek, the steel plate being fixedly connected to the first wide side of the head, the steel plate provides torque transmitting engagement on the nut or the bolt head; the two flanks forming a multi-point configuration for partially surrounding engagement in a torque-transmitting manner on said polygonal profile; and the third flank forming a stop for a portion of an end-face of said polygonal profile and is located on a boundary line between the first and the second wide sides.

2. The wrench according to claim 1, wherein the jaw cheeks are parallel to one another and form the stop.

3. The wrench according to claim 1, wherein the material of the steel plate is a hardened steel having a hardness of at least 50 HRC, wherein the hardness of the material of the steel base body that forms the rest of the head and the actuating arm having a hardness of 35 to 49 HRC.

4. The wrench according to claim 1, wherein the polygonal profile is a hexagonal profile, wherein the surfaces of the multi-point configuration are in the form of angled surfaces, each of the angled surfaces being located approximately midway along the jaw cheeks that run inclined at an angle of 120° with respect to the jaw cheeks, the jaw cheeks forming respective third flanks as the stop for a portion of an end face of the hexagonal profile.

5. The wrench according to claim 4, wherein the jaw cheeks running inclined at an angle of 30° with respect to the angled surfaces.

6. The wrench according to claim 4, wherein the jaw cheeks that are located opposite the jaw opening form the stop for contact with substantially an entire edge portion of an end face of a polygonal profile.

7. The wrench according to claim 1, wherein the steel plate is set into a recess in the first wide side of the head.

8. The wrench according to claim 1, wherein the steel plate is connected to the head by way of a force fit, by a positive connection, or by bonding.

9. The wrench according to claim 8, wherein the steel plate is connected to the head by way of a push fit, a screw connection, a riveted connection, an adhesive bond, or welding.

10. The wrench according to claim 1, wherein the steel plate is interchangeably associated with the wide side of the head.

11. The wrench according to claim 1, wherein the steel plate has a material thickness that equates to approximately one-half of the thickness of the material of the head.

12. The wrench according to claim 1, wherein the two angular notches that lie diametrically opposite one another each form just one contact flank.

13. The wrench according to claim 1, wherein the surfaces of the multi-point configuration that is located opposite the jaw opening forms a contact edge surface, the contact edge surface running substantially at right angles to the direction of extent of the jaw cheeks and making contact with substantially a complete polygon face of the polygonal profile.

14. The wrench according to claim 1, wherein the surface of the steel plate that is located opposite to the jaw opening, extends substantially at right angles to the extent of the jaw cheeks, merges into arcuate portions, the arcuate portions merging into the surfaces of the multi-point configuration that are located substantially close to the jaw cheeks.

15. The wrench according to claim 1, wherein the jaw cheeks and/or the surfaces of the multi-point configuration are provided with a roughened configuration to increase their gripping capability.

16. The wrench according to claim 15, wherein the jaw cheeks and/or the surfaces of the multi-point configuration are fluted, provided with a coating of frictional material, or toothed.

17. The wrench according to claim 1, wherein the jaw cheeks are interrupted by surfaces of a 12-sided polygon.

18. The wrench according to claim 1 wherein the two angular notches are substantially diametrically opposite to one another such that the nut can be radially secured in the head.

19. The wrench according to claim 1, wherein the opening formed by each of the two wide sides has a symmetrical configuration.

20. The wrench according to claim 1, wherein the jaw cheeks formed by the steel plate provides torque transmitting engagement on two parallel opposed faces of a polygonal profile of a nut or a bolt head.

* * * * *